US006595296B1

(12) United States Patent
French

(10) Patent No.: US 6,595,296 B1
(45) Date of Patent: Jul. 22, 2003

(54) HYDRAULIC CONTROL ASSEMBLY

(75) Inventor: Clive John French, Jambes (BE)

(73) Assignee: Quartech Engineering Limited (GB)

( * ) Notice: Subject to any disclaimer, the term of this patent is extended or adjusted under 35 U.S.C. 154(b) by 0 days.

(21) Appl. No.: 09/591,743

(22) Filed: Jun. 12, 2000

(30) Foreign Application Priority Data

Jun. 10, 1999 (GB) ..... 9913557

(51) Int. Cl.[7] ..... E21B 34/06; E21B 34/10

(52) U.S. Cl. ..... 166/375; 166/386; 166/321; 166/331

(58) Field of Search ..... 166/117.5, 373, 166/374, 375, 386, 105, 107, 108, 110, 316, 319, 320, 321, 322, 324, 331

(56) References Cited

U.S. PATENT DOCUMENTS

| | | | | | |
|---|---|---|---|---|---|
| 4,252,196 | A | * | 2/1981 | Silberman et al. | 166/318 |
| 4,432,417 | A | * | 2/1984 | Bowyer | 166/120 |
| 4,453,599 | A | * | 6/1984 | Fredd | 166/374 |
| 4,485,876 | A | * | 12/1984 | Speller | 166/373 |
| 4,846,272 | A | * | 7/1989 | Leggett | 166/126 |
| 5,415,237 | A | * | 5/1995 | Strattan | 166/375 |
| 5,564,501 | A | * | 10/1996 | Strattan et al. | 166/375 |
| 5,577,560 | A | * | 11/1996 | Coronado et al. | 166/387 |
| 5,906,220 | A | * | 5/1999 | Thompson | 137/492.5 |
| 6,152,224 | A | * | 11/2000 | French | 166/250.08 |
| 6,179,052 | B1 | * | 1/2001 | Purkis et al. | 166/53 |
| 6,257,331 | B1 | * | 7/2001 | Blount et al. | 166/125 |

FOREIGN PATENT DOCUMENTS

| | | |
|---|---|---|
| GB | 2279385 A | 1/1995 |
| GB | 2293842 A | 4/1996 |
| GB | 2 304 132 A | 3/1997 |
| WO | WO 97/05759 | 2/1997 |
| WO | WO 97/06344 | 2/1997 |
| WO | WO 98/54439 | 12/1998 |
| WO | WO 98/55731 | 12/1998 |
| WO | WO 99/19602 | 4/1999 |

* cited by examiner

*Primary Examiner*—David Bagnell
*Assistant Examiner*—Jennifer H Gay
(74) *Attorney, Agent, or Firm*—Gifford, Krass, Groh, Sprinkle, Anderson & Citkowski, P.C.

(57) ABSTRACT

Hydraulic control assemblies for controlling the operation of one or more downhole tools. In one embodiment of the invention, a hydraulic control assembly (10) includes a tubular member in the form of tubing (12), which carries axial chambers (14), each coupled to a downhole tool and carrying a flow controlling shuttle valve (24) and a gear rod (34). Tool control fluids inlets and outlets (18, 16) are provided in communication with each chamber (14), and flow through the chamber (14) to a downhole tool to control the tool. The shuttle valve (24) is movable by the gear rod (34) to selectively allow flow of control fluid to the tool. The gear rod (34) is movable in response to applied fluid pressure.

38 Claims, 7 Drawing Sheets

HYDRAULIC CONTROL ASSEMBLY

FIELD OF THE INVENTION

The present invention relates to a hydraulic control assembly. In particular, but not exclusively, the present invention relates to a hydraulic control assembly for controlling the operation of one or more downhole tools such as, for example, a circulation valve, a bore isolation unit, a gun system and/or any desired valve assembly.

BACKGROUND OF THE INVENTION

A variety of tools and valves are used downhole in an oil and/or gas well, which tools may, for example, be operated by annulus pressure, tubing pressure or control lines. In particular, a number of downhole tools are required in a borehole of an oil and/or gas well for drilling the borehole and throughout the production period of the well. Often a number of different tools are disposed within the borehole simultaneously, making individual control and/or operation of the tools complex. Furthermore, it may be difficult to ensure that a selected tool is in an activater or reactivated configuration as required.

Also, most downhole tools have internal mechanisms which cycle the tool, or operate them in a particular fashion. These mechanisms take the tool function in a unique and limited fashion. Furthermore, the tools become complex and cumbersome, with built-in weaknesses created by compromises between operating conditions, tool function and size.

It is amongst the objects of the present invention to obviate or mitigate at least one of the foregoing problems.

SUMMARY OF THE INVENTION

According to a first aspect of the present invention, there is provided a hydraulic control assembly for controlling the operation of a downhole tool, the assembly being for disposition in a borehole of a well and comprising:

a tubular member having a substantially axially extending chamber, the chamber having a tool control fluid inlet and outlet, the inlet for injecting a tool control fluid into the chamber, and the outlet for fluidly coupling to the downhole tool to control the operation of the tool; and flow control means for selectively allowing flow of the tool control fluid from the tool control fluid inlet to the tool control fluid outlet.

In this fashion, the present invention may allow a downhole tool coupled to the hydraulic control assembly to be selectively activated deactivated and/or maintained in an activated or deactivated configuration, by selectively allowing flow of the tool control fluid through the chamber of the tubular member.

Conveniently, the tubular member is a casing, lining or well tubing for running-in to the borehole. Preferably, the chamber is formed in a wall of the tubular member. Preferably also, a plurality of axially extending chambers are provided disposed spaced around a circumference of the wall of the tubular member. Alternatively, the chamber may be formed in a housing adapted to be coupled to a length of casing, lining or well tubing. The housing may be coupled to an outer or inner surface of the casing, lining or well tubing.

The flow control means may comprise a movable, substantially cylindrical shuttle valve disposed in the chamber, the shuttle valve comprising at least two radially extending seals for sealing the shuttle valve in the chamber and isolating the tool control fluid outlet from the tool control fluid inlet. The shuttle valve may be axially movable to selectively allow flow of the tool control fluid from the tool control fluid inlet to the tool control fluid outlet.

Conveniently, the flow control means further comprises a gear rod for axially moving the shuttle valve to allow flow of the tool control fluid. The gear rod may comprise ratchet teeth formed on an other surface thereof, and may co-operate with an axially movable mounting cage disposed in the chamber and having a ratchet arm for engaging the teeth of the gear rod. Thus the present invention may allow the shuttle valve to be axially moved to allow flow of control fluid to the downhole tool, by axially moving the gear rod in the mounting cage. Movement of the gear rod is achieved by an interaction between the ratchet teeth of the gear rod and the ratchet arm of the mounting cage.

Preferably, the mounting cage is substantially tubular. The mounting cage may include an upper piston disposed in a cylinder. Preferably, the flow control means further comprises a first fluid inlet fluidly coupled to the cylinder and a second fluid inlet fluidly coupled to the chamber. Thus by selectively injecting fluid into the cylinder and withdrawing fluid from the second fluid inlet, the cage may be moved axially towards the shuttle valve carrying the gear rod therewith.

The flow control means may further comprise a collect disposed in the chamber, the collet having radially extending ratchet arms for engaging the ratchet teeth of the gear rod. Thus, by injecting fluid via the second fluid inlet, and withdrawing fluid via the first fluid inlet, the cage may be moved axially away from the shuttle valve, with the gear rod retained by the collet. The gear rod may therefore be axially moved towards the shuttle valve in step wise fashion.

According to a second aspect of the present invention, there is provided a hydraulic control assembly for controlling the operation of a downhole tool, the assembly being adapted to be located in a borehole of a well and comprising:

a moveable piston;

a tubular member having a substantially axially extending chamber, the chamber having at least two tool control fluid ports for allowing tool control fluid to flow through the chamber; and flow control means for selectively allowing flow of tool control fluid through one of said ports to the chamber and from the chamber through the other one of said ports to the tool, to control operation of the tool, the flow control means being selectively activated, to allow tool control fluid flow to the tool, by the moveable piston.

Advantageously, this provides a hydraulic control assembly wherein a moveable piston may be moved to cause a flow control means to allow flow of tool control fluid to a downhole tool couple to the hydraulic control assembly. Preferably, flow of tool control fluid to the chamber occurs simultaneously with flow of tool control fluid from the chamber.

The piston may carry an operating finger for engaging the flow control means, to selectively activate the flow control means to in turn allow tool control fluid flow to the tool. Conveniently, the assembly includes a ratchet assembly for restraining the piston. The ratchet assembly may be a ball race ratchet including a ball race track formed in an outer surface of the piston and a ball adapted to engage in the track. The track may define a number of axially spaced rest positions for the ball, with a number of first rest positions for restraining the piston from further axial movement away from the tubular member, and a number of second rest positions, spaced axially from the first rest positions, to restrain the piston from further axial movement towards the tubular member. The rest positions may be formed in the track to define a continuous track for ball to follow. The first and second rest positions may be aligned around the circumference of the piston, and the track may define axial portions extending between the first and second rest positions, and angled track portions connecting adjacent pairs of first and second rest positions.

In this fashion, when the piston is moved axially towards and away form the tubular member, the piston is rotated by an interaction between the ball and the track. The piston may be moved axially by variation of a fluid pressure applied to the piston. This may be achieved by coupling a control line to the piston, or by varying the pressure internally within the hydraulic control assembly, or externally, in an annular defined between the assembly and a borehole wall. Conveniently, the ball is coupled to a casing or other tubing in which the hydraulic control assembly is located separately.

Preferably, the assembly includes two chambers and corresponding flow control means for controlling the operation of two downhole tools, or for separately controlling different aspects or operations of a single tool, for example the opening and closing of a valve. Alternatively, the assembly may include three or more chambers and corresponding flow control means. The piston may include operating fingers arranged so as to selectively activate a desired one or more flow control means in a desired order. Advantageously, the hydraulic control assembly is particularly adapted to the operating conditions required for manipulation of particular downhole tools, and these tools can be activated and/or deactivated by, for example, simple pressure signals in fluid in a borehole in which the assembly is located. Further advantageously, this allows each downhole tool required to perform a specific task to be very simple in structure and operation.

Preferably, the assembly comprises four tool control fluid ports, that is two fluid supply ports for flow of tool control fluid to the tool, and two fluid return ports for return or "bleedng off" of tool control fluid from the tool. The downhole tool may be coupled to the hydraulic control assembly in a closed loop with respect to the fluid in the chamber. Advantageously, this allows the downhole tool to be simply and effectively operated solely on the basis of opposing hydraulics, with operation of the tool in one fashion achieved by flow of control fluid to the tool from the chamber, and operation of the tool in the opposite or an alternative fashion by flow of control fluid from the tool into the chamber through the fluid return ports.

The tool control fluid ports may be spaced axially along the chamber and may be selectively isolated from one another by the flow control means. Each of the two fluid supply flow ports and the two fluid return flow ports may be mutually axially spaced.

The flow control means is preferably located in the chamber. The chamber may include seals for sealing the flow control means in the chamber to selectively isolate the tool control fluid ports. A pair of seals may be provided in the chamber axially straddling one of each of the two fluid supply flow ports and the two fluid return flow ports. In particular, seals may be provided axially straddling the fluid supply flow port, through which fluid flows from the chamber to the tool, and the fluid return flow port, through which fluid returns from the tool to the chamber.

The flow control means may be movable between deactivated and activated positions, where the means respectively prevents and allows tool control fluid flow to and from the tool to control operation of the tool. The assembly may further comprise biassing means for biassing the flow control means towards the deactivated position. The piston may act against the biassing means to move the flow control means to the activated position. In the deactivated position, the flow control means may isolate the tool control fluid ports to prevent communication between the ports to the tool. In the activated position, the flow control means may be moved to a position where the flow of tool control fluid is permitted between the tool control fluid ports and to the tool.

The flow control means may comprise an axially moveable plunger. The plunger may be spring biassed and may have an end adapted to be engaged by the moveable piston. Alternatively, the plunger may be moveable by application of fluid pressure. The plunger may be substantially cylindrical and may include a hollow portion defining a fluid conduit within the cylinder for selectively allowing fluid flow between the tool control fluid ports. Preferably, two such hollow portions are provided, one for each of the two fluid supply flow ports and fluid return flow ports. The piston in the region of the hollow portion may include apertures in a wall thereof, to allow fluid to enter the piston and into the fluid conduit.

Accordingly it will be understood that when the piston is moved between the deactivated and activated positions, the location of the tool control fluid ports and the seals with respect to the hollow portions selectively allows fluid communication between respective ones of the ports when the piston is moved axially to the activated position.

The plunger be adapted to be engaged by the moveable piston, and the plunger may be biassed by a biassing spring against the action of the movable piston.

The tubular member may include vent ports in the chamber provided for venting fluid from the chamber when the flow control means is moved by the moveable piston.

The hydraulic control assembly may further comprise a tool control fluid reservoir coupled to the chamber. The reservoir may be provided integrally with the tubular member, or may be provided externally of the tubular member. The reservoir may comprise a cylinder having an activating piston for ejecting fluid from the reservoir. The piston may be moved to eject fluid from the reservoir by application of fluid pressure. Fluid pressure may be applied by either control line, internal or external pressure acting on the hydraulic control assembly. The reservoir may be coupled to the chamber through one of the tool control fluid ports by a coupling fluid line. The reservoir may include a valve to prevent fluid return from the chamber.

Conveniently, the hydraulic control assembly includes fluid expansion vents to allow for expansion of the tool control fluid downhole. The fluid expansion vents may include cylinders having biassed pistons, the cylinders adapted to accommodate any expansion of the tool control fluid. Such may occur, in particular, due to the increased pressures and temperatures experienced downhole. The expansion vents are conveniently coupled to fluid flow lines of the hydraulic control assembly.

The hydraulic control assembly may further comprise restriction orifices provided in lines extending from the tool control fluid ports to prevent surge washing damage. Preferably, the restriction orifices are located in the lines through which fluid flows from the chamber to the tool and/or from the tool to the chamber.

According to a third aspect of the present invention, there is provided a method for controlling the operation of a fluidly activated downhole tool for disposition in a borehole of a well, the method comprising the steps of:

disposing the fluidly activated tool in the borehole;

fluidly coupling first and second control fluid supply conduits to the downhole tool in a fluidly closed-loop configuration; and Injecting control fluid into the downhole tool via a selected one of said first and second control fluid supply conduits, whilst simultaneously bleeding fluid out of the downhole tool via the other of said first and second control fluid supply conduits, to selectively activate the downhole tool.

Preferably, the method further comprises the step of measuring one of both of the volume of control fluid injected into the downhole tool or bled from the tool to allows accurate determination of an operating status of the downhole tool.

BRIEF DESCRIPTION OF THE DRAWINGS

An embodiment of the invention will now be described, by way of example, with reference to the accompanying drawings, in which:

FIG. 9A is an enlarged view of a fluid operation vent shown in FIG. 9.

DETAILED DESCRIPTION OF THE PREFERRED EMBODIMENT

Figure 1A:
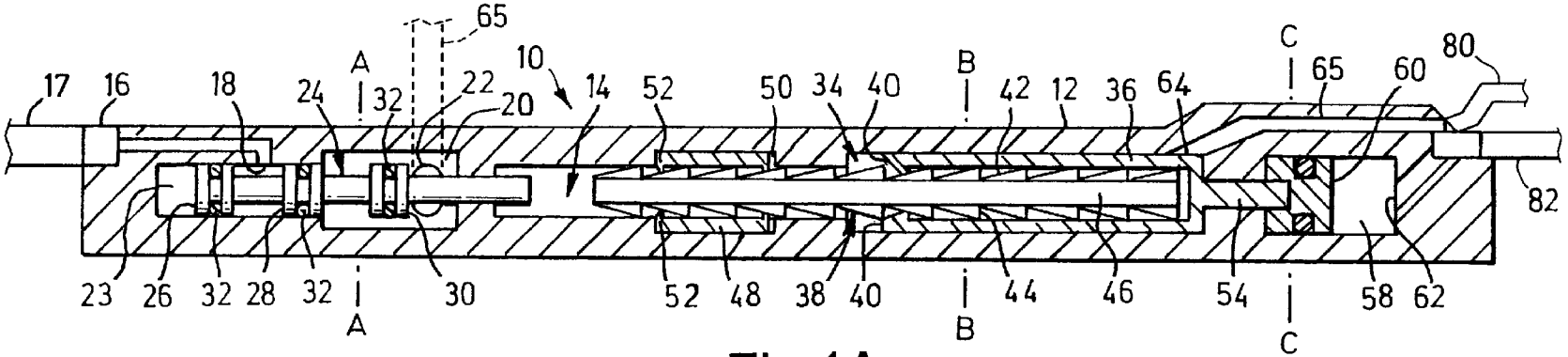
FIG. 1A is a longitudinal half-sectional view of a hydraulic control assembly in accordance with an embodiment of the present invention, shown in a closed configuration, with an associated tool (not shown) controlled by the assembly disposed in a deactivated configuration.
Figure 1C:
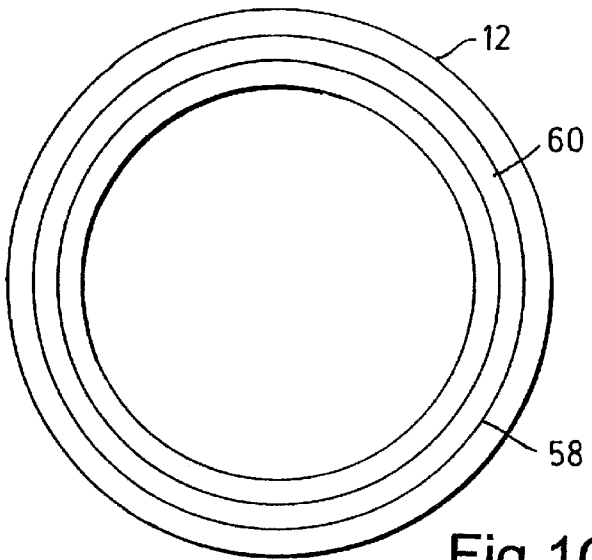
FIG. 1C is a cross-sectional view of the assembly of FIG. 1A, sectioned along line C—C of FIG. 1A.
Figure 1B:
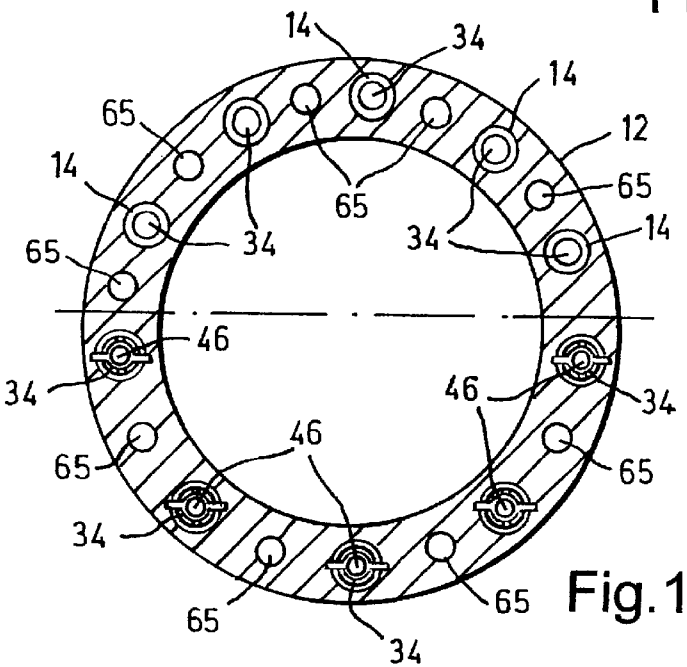
FIG. 1B is a cross-sectional view of the assembly of FIG. 1A, the upper portion of the figure showing the section along line A—A of FIG. 1A, and the lower portion of the figure showing the section along line B—B of FIG. 1A.

Referring firstly to FIGS. 1A to 1C, there is shown a longitudinal half-sectional view of a hydraulic control assembly in accordance with an embodiment of the present invention, and indicated generally be reference numeral 10. The assembly 10 comprises a length of tubing 12 with a number of chambers 14 extending axially along the tubing 12. This is shown more clearly in FIG. 1B, which is a cross-sectional view of the assembly of FIG. 1A, the upper portion of the figure showing the assembly 10 sectioned along line A—A and the lower portion sectioned of the figure showing the assembly sectioned along line B—B.

A tool control fluid outlet 16 is disposed lowermost in each chamber 14, and is coupled to a downhole tool (not shown) whose operation is to be controlled by the assembly 10. The outlet 16 is coupled to the chamber 14 and has an inlet port 18 in the chamber 14. Tool control fluid is injected into a portion 20 of the chamber 14 at the port 22. In the closed configuration shown in FIG. 1A, the tool is in a deactivated configuration, and the tool control fluid outlet 16 is isolated from control fluid in the portion 20 of the chamber 14 by a shuttle valve 24.

The shuttle valve 24 comprises three radially extending shoulders 26, 28 and 30, each of which carries an elastomeric seal 32. There seals 32 seal the shuttle valve 24 in the chamber 14, and the seals 32 on the shoulders 26 and 28 isolate the inlet port 18, and therefore the tool control fluid outlet 16, from the portion 20 of the chamber 14 and the port 22.

A gear rod 34 is mounted in the chamber 14 by a mounting cage 36, the gear rod 34 including a number of ratchet teeth 38. The mounting cage 36 is generally tubular and in the form of a sleeve, and includes resilient ratchet arms 40 adapted to move over an inclined surface 42 of each ratchet tooth 38; and to engage a rear surface 44 of each ratchet tooth 38, which surface 44 extends substantially perpendicularly from a shaft 46 of the gear rod 34. A collet 48 is disposed in a recess 50 formed in a wall of the chamber 14, and includes ratchet arms 52 for engaging the rear surface 44 of the ratchet teeth 38.

The mounting cage 36 also includes an upper cylindrical extension 54 which extends into an annular cylinder 58 in which an annular piston 60, fixed to the extension 54, is disposed. The piston 60 is best shown in FIG. 1C, which is a cross-sectional view of the assembly 10 of FIG. 1A, sectioned along line C—C of FIG. 1A. The cylinder 58 also includes a fluid inlet port 62 for injecting a fluid into the cylinder 58 via a main balance control conduit (not shown), extending from the tubing 12, out of the borehole and to the surface, as will be described in more detail below. A second fluid inlet port 64 is provided for injecting a fluid into the chamber 14 in the region of the mounting cage 36. This allows a fluid to be selectively injected into and bled from the chamber 14 and the cylinder 58, to control operation of the tool coupled to the assembly 10 via the tool control fluid outlet 16, as will be described in more detail below. Furthermore, fluid is injected at the port 22 and through the second fluid inlet port 64 from a second control conduit 65 extending through the tubing 12. Control conduits 65 extending from each chamber 14 are disposed spaced around the tubing 12, and may be coupled via a manifold (shown in FIG. 4 and described below) to a single main control conduit extending to the surface.

Figure 2:
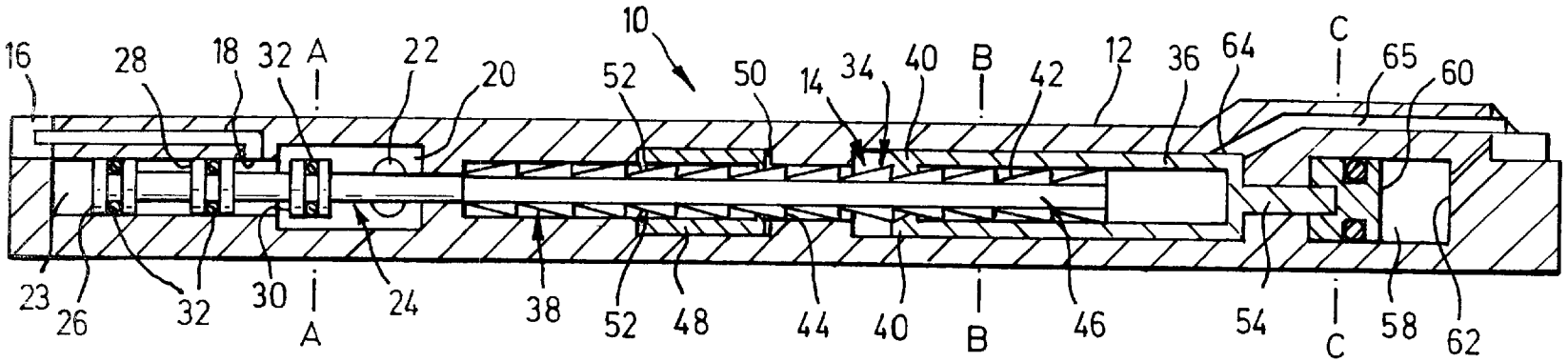
FIG. 2 is a view of the hydraulic control assembly of FIG. 1A, shown in an open configuration, with the associated tool in an activated configuration.

Referring now to FIG. 2, the hydraulic control assembly 10 of FIG. 1A is shown in an open configuration, with the tool coupled to the assembly 10 in an activated configuration. The tool is actuated to the activated configuration by moving the gear rod 34 axially towards the shuttle valve 24, until the gear rod 34 comes into contact with the shuttle valve 24. Further axial movement of the gear rod 34 moves the shuttle valve 24 axially downwardly until the shoulder 28 of the shuttle valve 24 moves past the inlet port 18, allowing fluid communication between the port 22 and the inlet port 18, and thus allowing tool control fluid to flow from the outlet 16 to the tool to activate the tool. The shuttle valve 24 includes a locking mechanism (not shown) such as a latch assembly, which initially maintains the shuttle valve 24 in the position shown in FIG. 1A, and thus maintains the tool coupled to the assembly 10 in a deactivated configuration. The locking mechanism is deactivated by a leading end of the gear rod 34 as it approaches and engages the shuttle valve 24.

The fluid communication between the port 22 and the inlet port 18 is achieved first injecting fluid into the cylinder 58 via fluid inlet port 62, causing the piston 60 to move axially downwardly, carrying the gear rod 34 therewith, as described above. Fluid in the cylinder 58 and the control line coupled thereto is maintained at a constant pressure of 1000 psig (accounting for thermal expansion) whilst allowing fluid to bleed from the chamber 14 via the second fluid inlet 64 and associated control conduit 65. When the mounting cage 36 has reached the end of its travel, the cage is retracted by injecting control fluid at a relatively high pressure into the chamber 14 via the second fluid inlet 64, creating a pressure differential across the piston 60 of approximately 2000 psig. Simultaneously, fluid is allowed to bleed off, still at a constant pressure of 1000 psig, from the cylinder 58 via inlet port 62. As the cage 36 retracts, the ratchet arms 40 move over the inclined surface 42 of each ratchet tooth 38, with the gear rod 34 maintained in an axially fixed position by an interaction between the ratchet arms 52 of the collet 48, and the rear surface 44 of the ratchet teeth 38.

This movement of the mounting cage 36 and the gear rod 34 is repeated until the gear rod 34 comes into contact with the shuttle valve 24 and moves the valve to the position shown in FIG. 2. Also, the volume 23 defined between the shoulder 26 of the shuttle valve 24 and the end of the chamber 14 is fluidly coupled to the second control conduit 65 such that the volume 23 experiences the same fluid pressure as the control fluid injected into the chamber 14 at the port 22 and via the second fluid inlet 64. This allows the shuttle valve 24 to move axially at a controlled rate, as described above.

Furthermore, the gear rod 34 only moves axially to move the shuttle valve 21 when control fluid is allowed to bleed from the port 22 and the second fluid inlet 64. This prevents the second control conduit 65 and the chamber 14 from experiencing elevated pressures when the shuttle valve 24 is moved.

Figure 3:
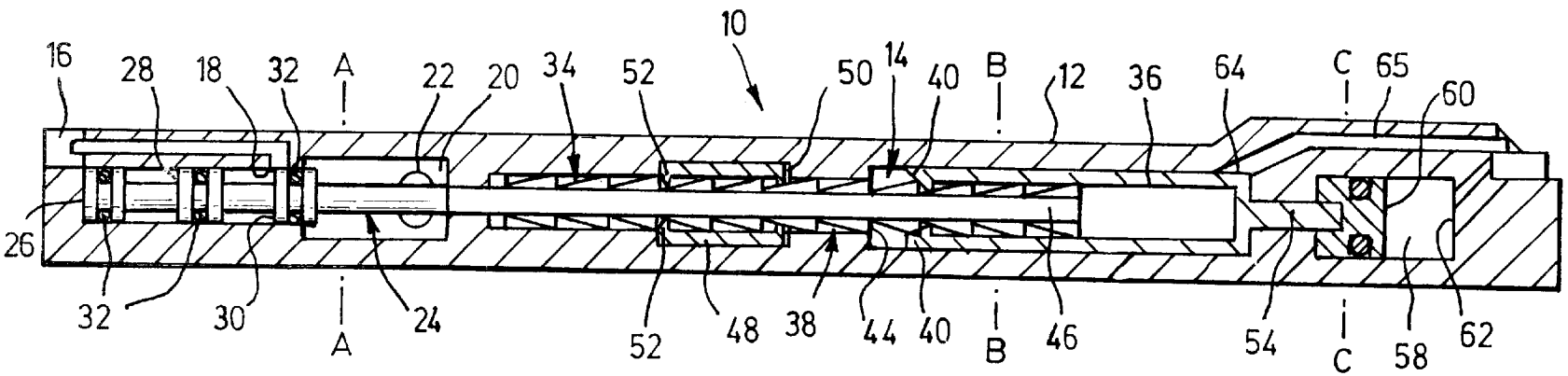
FIG. 3 is a view of the hydraulic control assembly of FIG. 1A, shown in a closed configuration, with the associated tool maintained in an activated configuration.

Referring now to FIG. 3, the hydraulic control assembly 10 of FIG. 1A is shown in a closed configuration, with the tool coupled to the assembly 10 via the tool control fluid outlet 16 being maintained in an activated configuration. This is achieved by further movement of the gear rod 34 in an axial direction as described in relation to FIGS. 1A to 2 above. The resulting further axial movement of the shuttle valve 21 beyond the position shown in FIG. 2 causes the shoulder 30 to move to the position shown in FIG. 3, sealing the inlet port 18 and maintaining fluid pressure in the control conduit (not shown) coupled to the tool via the outlet 16, thus maintaining the tool in the activated configuration. When the assembly 10 reaches the position shown in FIG. 3, the assembly 10 is "spent", and requires removal and re-setting for subsequent reuse. As the gear rod 34 and thus the shuttle valve 24 only move when control fluid is bled off from the port 22 and the second fluid inlet 64, this prevents fluid being "trapped" at a relatively high pressure in the control line coupling the tool to the outlet 16.

The arrangement of a plurality of chambers 14 around the circumference of the tubing 12 allows a number of downhole tools to be disposed within the borehole, with one such tool coupled to a selected one of the chambers 14 via a respective tool control fluid outlet 16 and by respective first control fluid supply conduit 17. By varying the required travel of each gear rod 34 to move the shuttle valve 24 and activate each one of the tools, the downhole tools can be selectively activated in a desired order.

Figure 4:
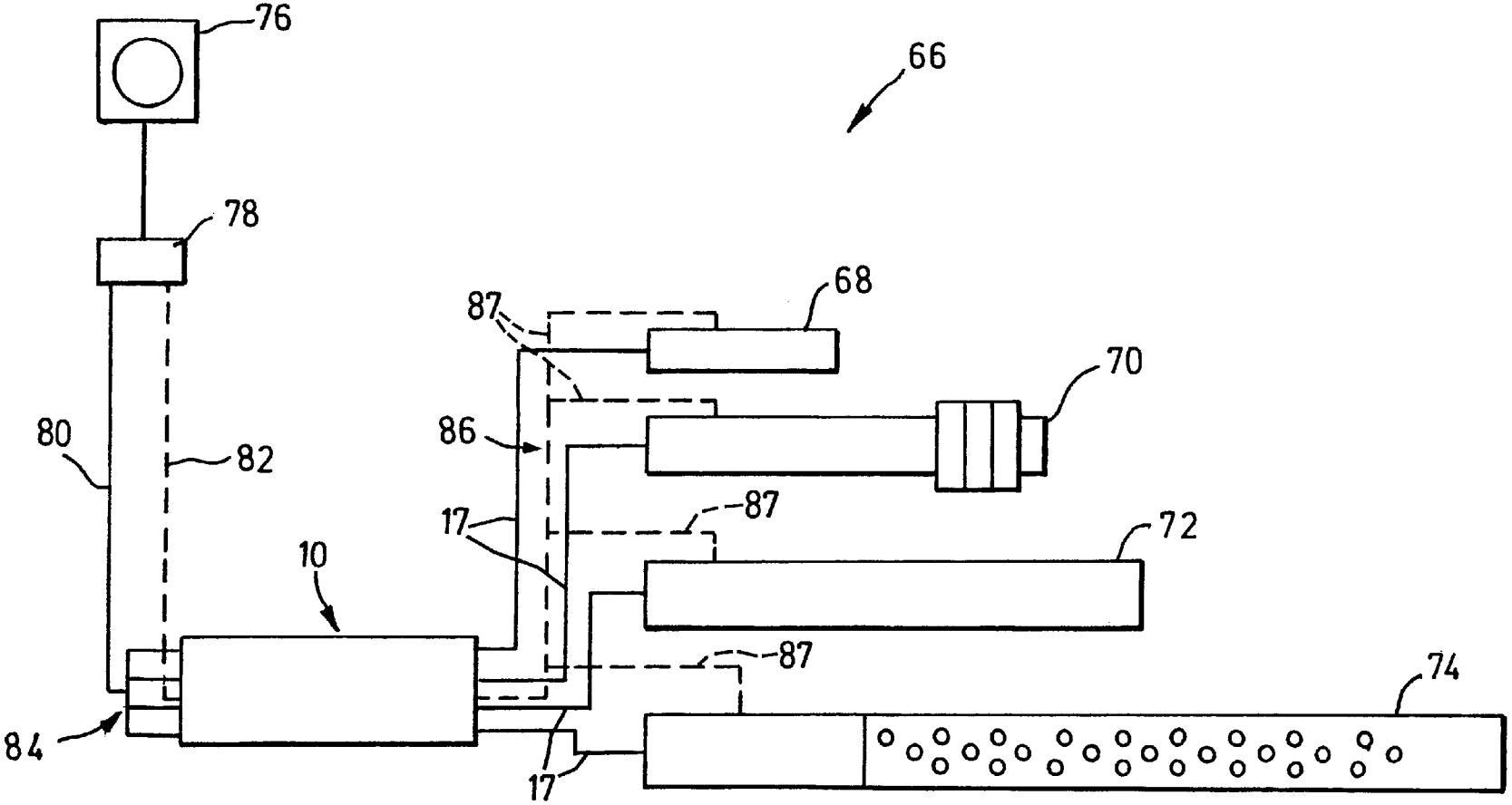
FIG. 4 is a schematic illustration of a borehole assembly incorporating the hydraulic control assembly of FIG. 1A.

Referring now to FIG. 4 there is shown a schematic illustration of a borehole assembly indicated generally by reference numeral 66, which includes the hydraulic control assembly 10 of FIGS. 1A to 3. A main control conduit 80 is coupled via a manifold 84 to each control conduit 65, to inject control fluid into each chamber 14 at the port 22 and via the second fluid inlet 64, as described above with reference to FIGS. 1A to 3. A main balance control conduit 82 is coupled to the cylinder 58 to inject control fluid into the cylinder 58 via the first fluid inlet port 62, also described above. A circulation valve 68, a bore isolation unit 70, a valve system 72 and a gun system 74 are each coupled to a respective chamber 14 via a selected tool control fluid outlet 16 and first fluid supply conduit 17. Also, each of the tools 68, 70, 72 and 74 are coupled to the main balance control conduit 82 via the assembly 10 and a second manifold 86 having second control fluid supply conduit 87. The fluid in the cylinder 58 and therefore in the main balance control conduit 82 and the second manifold 86 is maintained at a substantially constant pressure of 1000 psig, as described above. Thus a constant fluid pressure is applied to each of the tools 68, 70, 72 and 74, to maintain control valves or the like in each tool 68, 70, 72 and 74 in a closed configuration, until such time as control fluid is injected via manifold 84, outlet 16 and first conduit 17. As will be appreciated by persons skilled in the art, this ensures that the selected tool 68, 70, 72 or 74 remains in a deactivated configuration until control fluid is injected from the relevant outlet 16 and first conduit 17.

A relatively short travel of the gear rod 34 is required to move the respective shuttle valve 24 for the gun system 74 to activate the system. The valve system 72, bore isolation unit 70 and the circulation valve 68 require progressively greater travel of their respective gear rods 34. Thus applying fluid pressure via the manifold 84 and each control conduit 65 to each chamber 14 may only initially activate the gun system 74. A second tool, such as the valve system 72, may requires a longer travel by its respective gear rod 34 to activate the valve system, such that a further fluid pressure cycle will move the valve system 72 to an activated configuration. Further movement of the gear rods 34 may progressively activate the remaining tools 70 and 68 in a desired order.

The assembly 66 also includes a computer 76 for controlling and monitoring operation of the tools 68, 70, 72 and 74 via the assembly 10, and a hydraulic power source 78 for supplying the required hydraulic fluids. Also, the borehole assembly 66 includes a pressure compensation system (not shown) to compensate for differential pressures experienced within the main control and/or main balance control conduits 80 and 82, and/or within the manifolds 84 and 86, which may cause crush strength of the respective components to be approached. The system automatically increases the pressure of control fluid within the conduits 80 and 82 and the manifolds 84 and 86, to reduce the differential pressure and prevent the crush strength being exceeded.

As will be appreciated by persons skilled in the art, activation of each of the tools 68, 70, 72 and 74 can be accurately controlled simply by regulating and gauging the volume of control fluid injected down or bled from a selected one of the main control conduit 80 and the main balance control conduit 82 as appropriate. The computer 76 provides this regulation and thus controls operation of the tools 68, 70, 72 and 74.

Figure 5A:
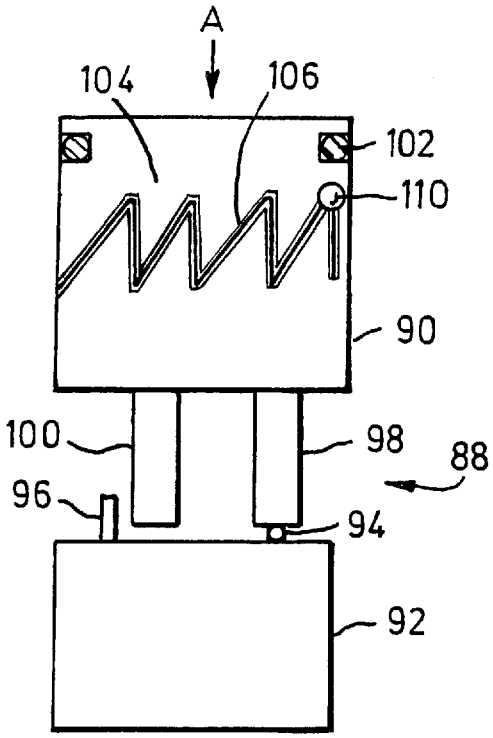
FIG. 5A is a schematic side view of a hydraulic control assembly in accordance with an alternative embodiment of the present invention, shown in a position where the assembly is activated, for controlling the operation of an associated tool (not shown) coupled to the assembly.

Referring now to FIG. 5A, there is shown a schematic side view of a hydraulic control assembly in accordance with an alternative embodiment of the present invention, indicated generally by reference numeral 88. The assembly 88 is shown in FIG. 5A in an activated position, for controlling the operation of a downhole tool (not shown) coupled to the assembly 88.

Figure 5B:
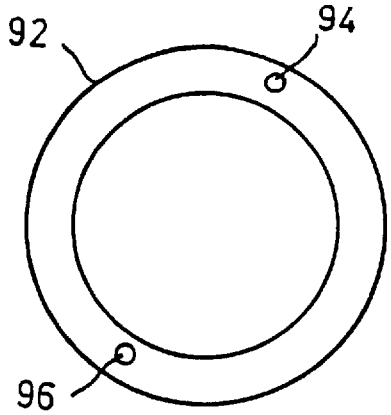
FIG. 5B is a schematic plan view of a tubular member forming part of the assembly of FIG. 5A.

The assembly 88 generally comprises an axially moveable piston 90 and a tubular member in the form of a plunger housing 92. The assembly 88 is run into a casing lined borehole on drill pipe, tubing or coiled tubing. The piston 90 is an annular piston mounted on a central cylindrical mandrel (not shown) of the plunger housing 92 which extends up through the piston 90. The plunger housing 92 is shown in the plan view of FIG. 5B. The piston 90 is axially movable towards and away from the plunger housing 92 over the mandrel.

The plunger housing 92 will be discussed in more detail with reference to FIGS. 8 and 9 below, however, the plunger housing 92 includes inner axially extending chambers in which flow control means in the form of plungers 92 and 96 are located. The plungers 94 and 96 are selectively engaged by operating fingers 98 and 100, respectively, of the piston 90.

Figure 5D:
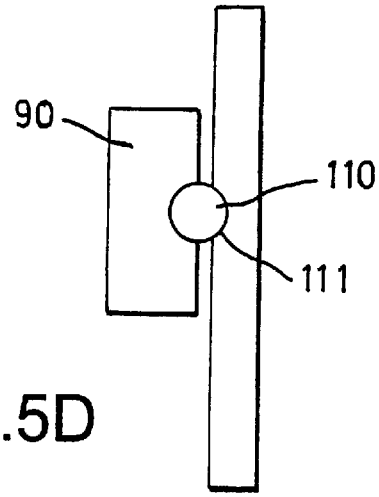
FIG. 5D is a schematic cross-sectional view of part of the ratchet assembly of FIG. 5C.
Figure 5C:
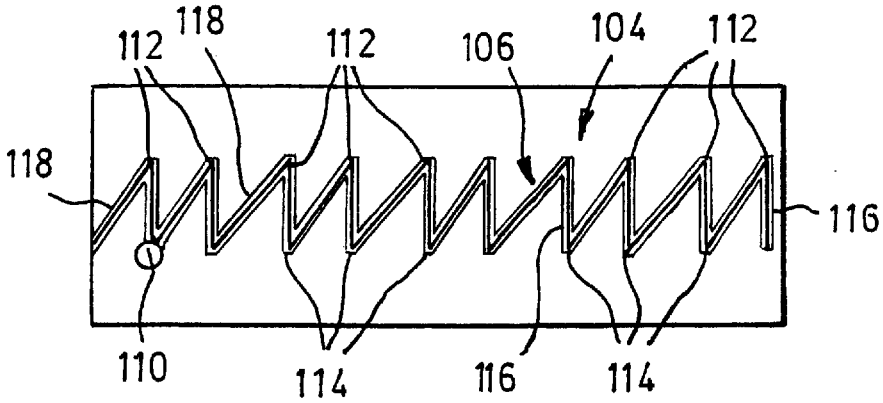
FIG. 5C is a schematic view of a ratchet assembly of a piston forming part of the assembly of FIG. 5A, shown in flattened profile.

The assembly 88 is shown in FIG. 5A located in the casing, and the piston 90 carries an O-ring type seal 102, for sealing the piston 90 to the casing. The assembly 88 also includes a ratchet assembly 104, shown in more detail in the schematic flattened profile view of FIG. 5C, which governs the motion of the piston 90 with respect to the plunger housing 92. The ratchet assembly 104 takes the form of a "ball race ratchet", and includes a ball race track 106 formed in an outer surface 108 of the piston 90, and a ball 110, located between the casing and the piston 90. The ball 110 sits in a depression in a wall of the casing, shown in the partial cross-sectional view of FIG. 5D, and is movable along the ball race track 106 to govern the motion of the piston 90. The track 106 defines a number of first ball rust positions 112 and a number of second ball rest positions 114. The first and second ball rest positions 112, 114 are connected by an axially extending portion 116 of the track 106, and adjacent pairs of rest positions by angled portions 118.

When the assembly 88 has been run into a borehole with any desired tools (such as valves, isolation units, valve or gun systems) connected to the assembly 88, fluid pressure is applied to the piston 90 of the assembly 88 to move the piston 90 axially towards the plunger housing 92 in the direction of the arrow A. The movement continues until the ball 100 comes to rest in one of the first ball rest positions 112 shown in FIG. 5A, which restrains the piston 90 from further axial movement toward the piston 92.

Movement of the piston 90 in this fashion causes the operating finger 98 to engage and depress the plunger 94. As will be described in more detail below, this allows flow of tool control fluid from chambers defined in the plunger housing 92 to a tool, to control operation of the tool, for example, to bring it to an activated position. Thus where, for example, the tool comprises a valve, depression of the plunger 94 in this fashion may open or close the valve.

Figure 6:
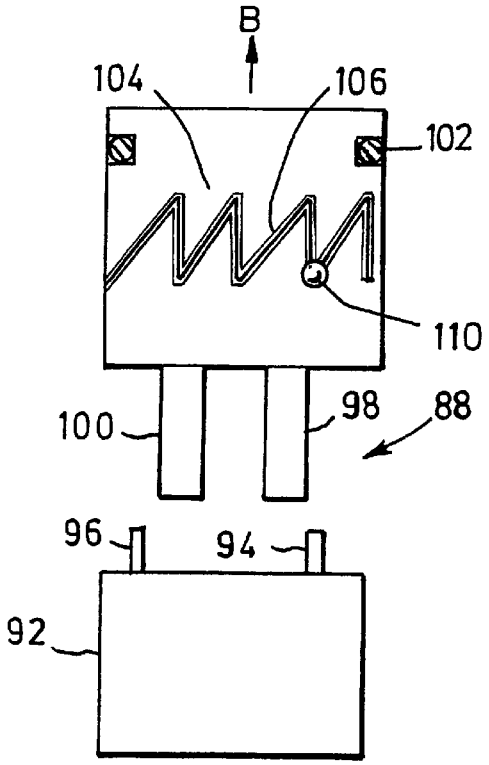
FIGS. 6 and 7 are views of the assembly of FIG. 5A shown following movement to a deactivated position and to a further activated position, respectively (on same sheet as FIGS. 5A and 5B)
Figure 7:
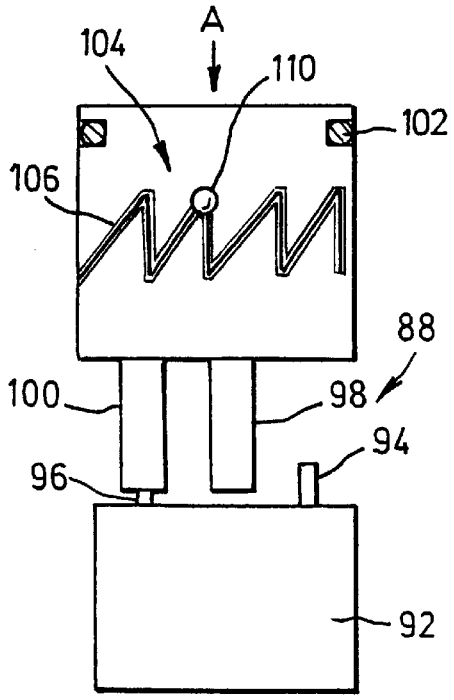

Turning now to FIG. 6, there is shown a view of the assembly 99 of the FIG. 5A following movement to a deactivated position, where the operating fingers 98 and 100 are moved away from the plunger housing 92. This is achieved by bleeding off the pressure acting on the piston 90, which under the action of a biassing spring (not shown) is urged away from the plunger housing 92 in the direction of the arrow B. This causes the plunger 94 to return to a deactivated position where flow of tool control fluid to the relevant tool is prevented. The pressure is bled off the piston 90 until the ball 110 comes to rest against one of the second ball rest positions 114, as shown in FIG. 6. This restrains the piston 90 from further axial movement in the direction away from the plunger housing 92, and the operating finger has fully released the plunger 94. Simultaneously, during movement of the piston 90 in the direction B, the piston is rotated with respect to the plunger housing 92 by an interaction between the ball 110 and the angled portion 118 of the track 106.

Figure 5E:
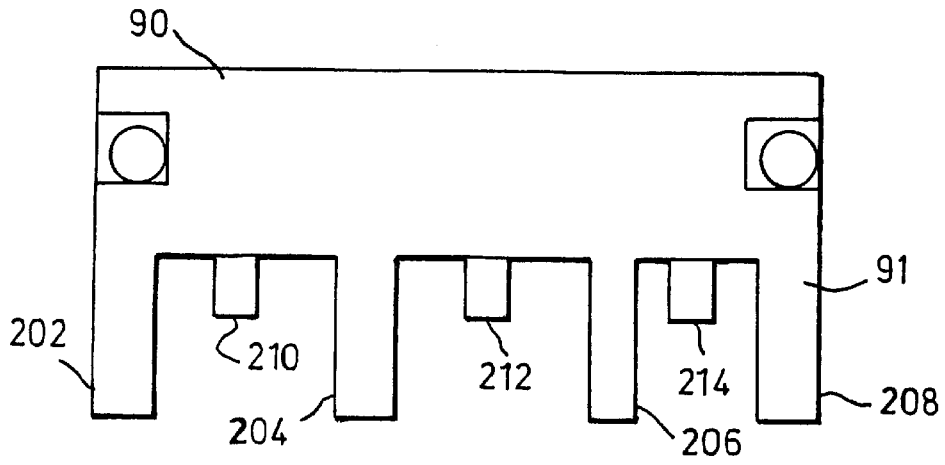
FIG. 5E is a schematic view showing part of the piston of FIG. 5A in greater detail.

Subsequent application and bleeding off of pressure acting on the piston 90 further rotates the piston 90 until the operating finger 100 aligns with the plunger 96. The piston 90 can then be moved axially towards the plunger housing 92 in the direction of the arrow A, bringing the operating finger 100 into engagement with the plunger 96, to control operation of a second downhole tool. Thus it will be understood that the assembly 88 may be used for selectively controlling the operation of a desired tool, and interaction may be obtained with any desired number of plungers in the plunger housing 92. FIG. 5E shows a lower part 91 of the piston 90 with an alternative arrangement of operating fingers 202, 204, 206 and 208, of a common length and spaced around a circumference of piston 90, and operating fingers 210, 212, 214 of a shorter common length and similarly spaced around the piston 90. This is particularly advantageous in allowing specific, simple control of a plurality of tools in a desired order.

Figure 8:
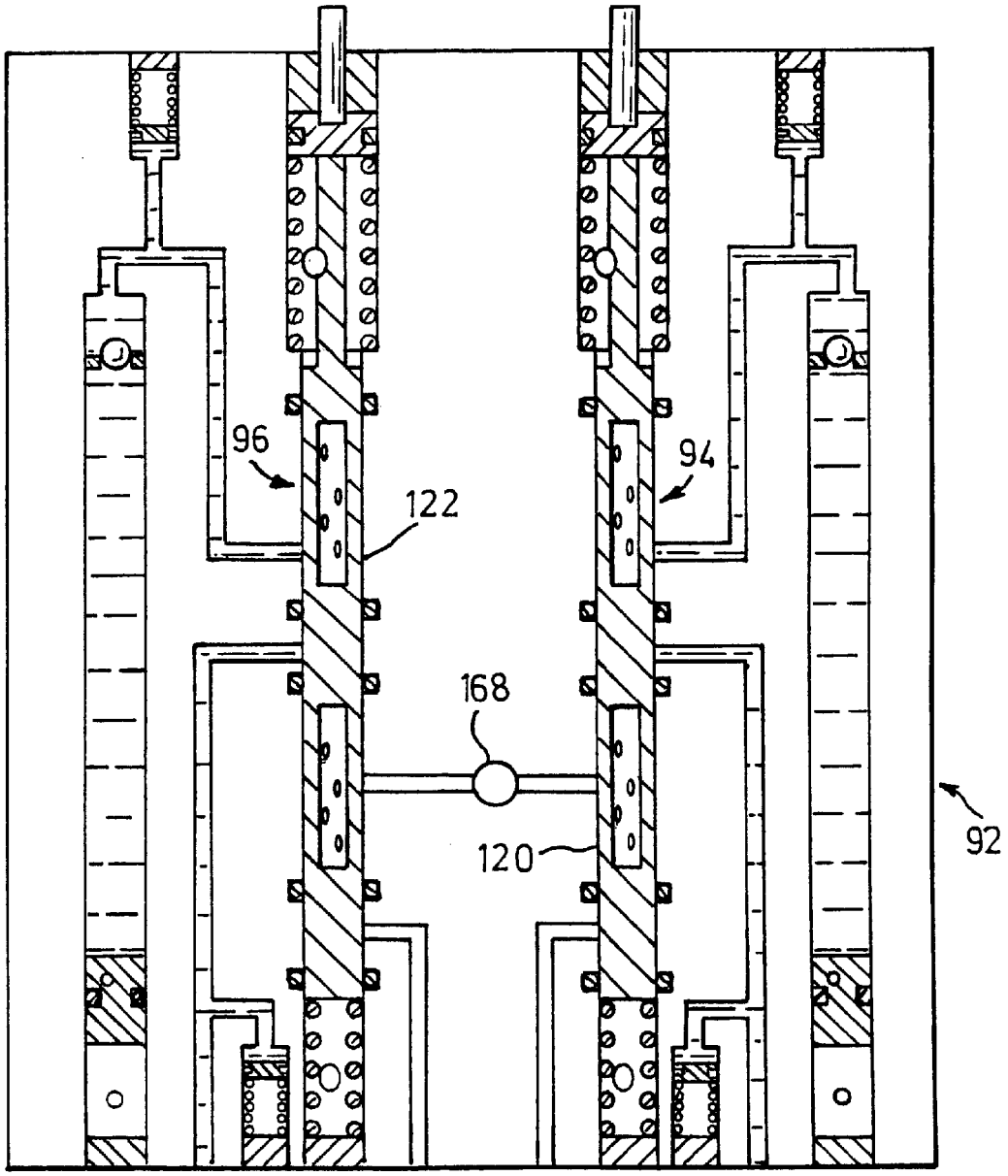
FIG. 8 is an enlarged schematic sectional of view of the tubular member forming part of the assembly of FIG. 5A.

Turning now to FIG. 8, there is shown an enlarged schematic view of the plunger housing 92 of FIG. 5A. The plunger housing 92 includes axially extending chambers 120, 122 in which the plungers 94 and 96 are located. Each of the plungers 94, 96 and the respective chambers 120, 122 are identical, and FIG. 9 is an enlarged view of the plunger housing 92 of FIG. 8 showing the plunger 94 in more detail. The plunger 94 has an upper end 124 for engagement with the operating fingers of the piston 90, and which is mounted in the chamber 120 by a piston head 126, which carries an O-ring seal 128 for sealing the piston head 126 to the chamber 120. A biassing spring 130 is located in an upper portion 132 of the chamber 120, to exert a biassing force upon the piston head 126, tending to urge the upper end 124 of the plunger 94 in a direction towards the piston 90. A main part 134 of the plunger 94 is generally cylindrical, but includes hollow portions 136 and 138 which define short fluid paths or conduits. Apertures 140 and 142 are formed in a wall of the main part 134 of the plunger 94 in the region of the hollow portions 136, 138, respectively.

The chamber 120 carries a number of O-ring seals for sealing the plunger 94 in the chamber. Specifically, an upper seal 144 is provided at an upper end of the main part 134, whilst O-ring seal pairs 146 and 148 are provided spaced along the chamber 120.

A wall of the chamber 120 defines a first pair of flow ports 150, 152 and a second pair of flow ports 154, 156, which allow for fluid communication between the downhole tool and the chamber 120. The flow port 150 is connected via line 158, formed in the plunger housing 92, to a tool control fluid reservoir 160, which supplies tool control fluid to the chamber 120. The flow port 152 is similarly connected via a line 162 to the tool to be controlled. Also, the port 156 is connected via a line 164 to the tool, whilst the port 154 is coupled via lines 166 to a bleed point 168, shown in FIG. 8, which is common for the two plungers 94 and 96.

Figure 9:
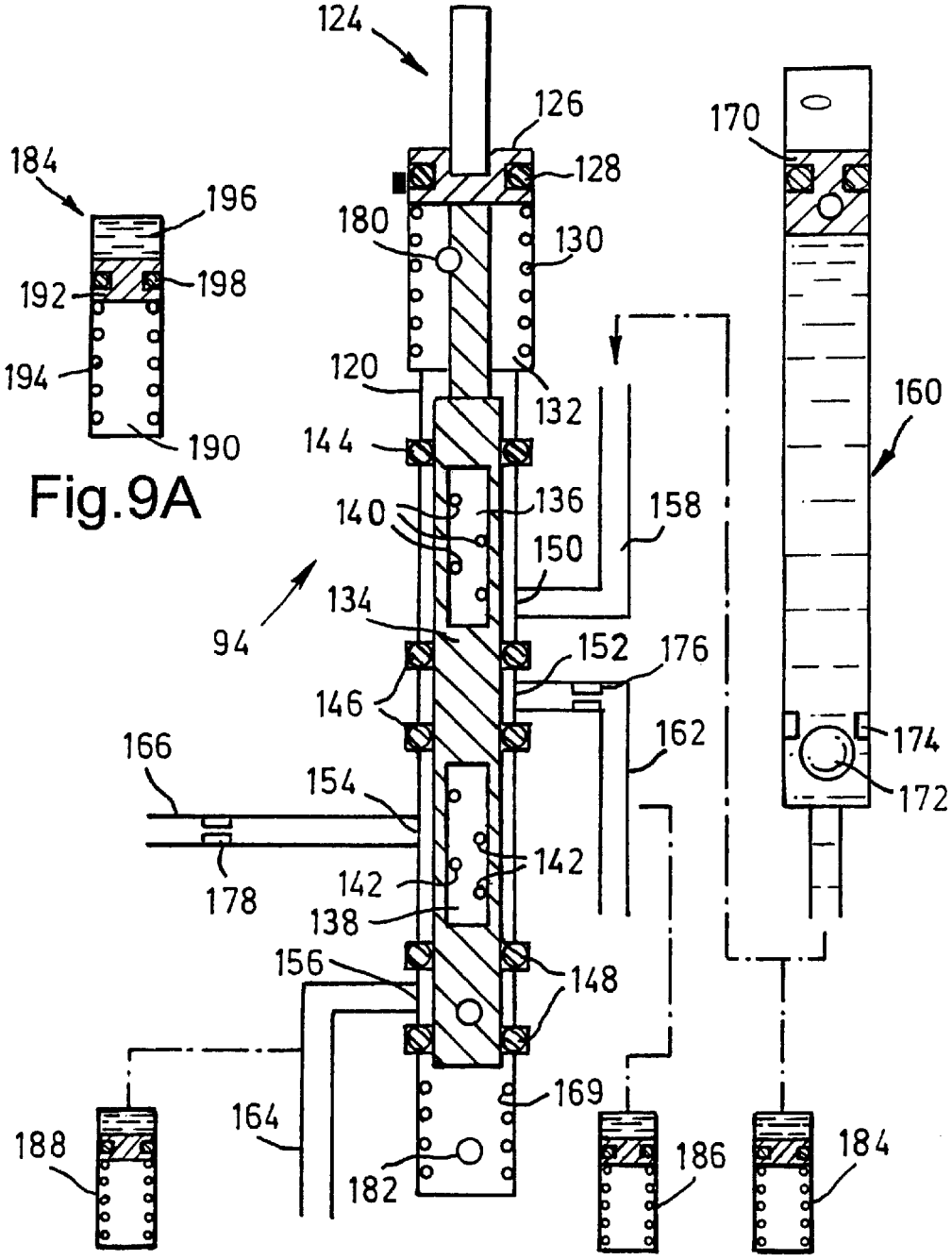
FIG. 9 is an enlarged view of the part of the tubular member shown in FIG. 8.

The plunger 94 is shown in FIG. 9 in a deactivated position corresponding to that shown in FIG. 6, where there is no fluid flow between the tool and the chamber 120 of the plunger housing 92. The plunger 94 is therefore in the position where the upper end 124 of the plunger 94 has been moved upwardly toward the piston 90, and where a biassing spring 169 in the chamber 120 has forced the main part 134 of the plunger 94 upwardly to the position shown in FIG. 9. In this position, the flow port 150 is isolated from the flow port 152, and the flow port 156 is isolated from the flow port 154, by the seal pairs 146 and 148. It will also be noted that the flow ports 150, 152 and 154, 156 are mutually isolated, by the seal pair 146. The tool therefore resides in a desired state of activation and is therefore retained in this state until the plunger 94 is moved.

To change the activation state of the tool, the piston 90 is moved axially towards the plunger housing 92 to the position shown in FIG. 5A, depressing the upper end 124 of the plunger 94, moving the plunger end 124 and main part 134 axially downwardly against the action of the biassing springs 130, 169. This moves the hollow portions 136, 138 to a position where the portion 136 straddles the ports 150 and 152 and where the portion 138 straddles the ports 154 and 156. If fluid pressure is then applied to a piston 170 in the tool control fluid reservoir 160, which forces a ball valve 172 away from its seat 174, the reservoir 160 supplies tool control fluid via the line 158 to the port 150, through the fluid conduit defined by the hollow portion 136 and into the flow port 152. Control fluid is thus supplied through the line 162 to the tool to activate/deactivate the tool. To prevent surge washing of, in particular, the seals in the chamber 120, a restriction orifice 176 is disposed in the line 162. Surge washing may occur when there is a high pressure differential, for example across the seal pair 146, which is suddenly released when the plunger 94 is moved.

Simultaneously, tool control fluid is returned from the tool through the line 164 and port 156 into the fluid conduit defined by the hollow portion 138, through the port 154 and line 166 to be vented from the point 168. A similar restriction orifice 178 is provided in the line 166, to prevent surge washing, as described above.

Fluid pressure is applied to the piston 170 of the fluid reservoir 160 either by control line, by internal bore pressure or external annulus pressure acting upon the assembly 88.

When it is desired to change the activation state of the tool coupled to the chamber 120, the piston 90 is allowed to move axially away from the plunger housing 92, as shown in FIG. 6 and described above, such that the plunger 94 returns to the position shown in FIG. 9, where the flow ports 150, 152 and 154, 156 are again isolated. To enable movement of the plunger 94 within the fluid filled chamber 120, venting ports 180 and 182 are provided to allow fluid venting from the chamber 120.

In addition, due to the hostile conditions experienced downhole, particularly the high temperatures and pressures experienced, the tool control fluid may expand. To prevent damage to the assembly 88, each of the lines 158, 162 and 164 includes fluid expansion vents 184, 186 and 188, respectively. The fluid expansion vent 184 is shown enlarged in FIG. 9A and comprises a cylinder 190 which carries a piston 192. The piston 192 is sealed in the cylinder 190 by an O-ring seal 198 and is biassed by a biassing spring 194 into contact with tool control fluid 196. Expansion of the fluid 196 forces the piston 192 against the biassing spring 194 comprising the spring and allowing the fluid 196 to expand to take up the volume of the cylinder 190.

It will be appreciated that the plunger 94 and the associated components of the plunger housing 92 are substantially identical for the plunger 96 shown in FIG. 8.

Various modifications may be made to the foregoing within the scope of the present invention. For example, in the assembly 10 of FIGS. 1 to 4, the ratchet teeth 38 may be spring-loaded, and the ratchet arms 40 of the gear rod 34 and the ratchet arms 52 of the collet 48 may be fixed, to allow the required movement of the gear rod 34.

What is claimed is:

1. A hydraulic control assembly for controlling the operation of at least a first and second downhole tool, the assembly being for location in a borehole of a well and comprising:

a tubular member having a tool control fluid inlet means coupled by at least one control conduit to a tool control fluid source such that tool control fluid is isolated from borehole fluid, and at least a first and a second tool control fluid outlet, the first and second outlets for coupling to the respective first and second downhole tool; and a valve assembly for selectively allowing flow of tool control fluid between the tool control fluid inlet means and the first tool control fluid outlet and between the tool control fluid inlet means and the second tool control fluid outlet, to provide independent, selective control of the operation of each downhole tool.

2. An assembly as claimed in claim 1, wherein the control assembly further comprises a chamber formed in a wall of the tubular member between an inlet of the inlet means and the outlets.

3. An assembly as claimed in claim 2, wherein the control assembly further comprises at least two axially extending chambers disposed spaced around a circumference of the wall of the tubular member, each chamber having a respective tool control fluid inlet and at least one tool control fluid outlet.

4. An assembly as claimed in claim 2, wherein the valve assembly comprises a shuttle valve disposed in the chamber.

5. An assembly as claimed in claim 4, wherein the valve assembly further comprises a gear rod for axially moving the shuttle valve.

6. An assembly as claimed in claim 5, wherein the gear rod defines ratchet teeth, and cooperates with an axially movable mounting cage disposed in the chamber and having a ratchet arm for engaging said teeth.

7. An assembly as claimed in claim 6, wherein the valve assembly further comprises a piston coupled to the mounting cage and disposed in a cylinder and a first fluid inlet fluidly coupled to the cylinder and a second fluid inlet fluidly coupled to the chamber.

8. An assembly as claimed in claim 6, wherein the valve assembly further comprises a collet disposed in the chamber, the collet having radially extending ratchet arms for engaging the ratchet teeth of the gear rod.

9. A hydraulic control assembly for controlling the operation of at least two downhole tools, the assembly being adapted to be located in a borehole of a well and comprising:

a piston;

a tubular member defining at least a first and a second chamber, each chamber having at least two tool control fluid ports for allowing tool control fluid to flow through the chamber and each chamber being adapted to be selectively coupled by at least one control conduit to a tool control fluid source such that the tool control fluid is isolated from borehole fluid; and a valve assembly operatively associated with the piston, for selectively allowing flow of the tool control fluid from the tool control fluid source through one of said ports of each first and second chamber into the respective chamber, and from the respective chamber through the other one of said ports of each first and second chamber to a respective downhole tool, to provide independent, selective operation of the first and second downhole tools.

10. An assembly as claimed in claim 9, wherein the piston is an annular piston.

11. An assembly as claimed in claim 9, wherein the piston carriers an operating member for engagement with the valve assembly, to selectively activate the valve assembly to allow the tool control fluid to flow to the respective tool.

12. An assembly as claimed in claim 9, wherein the assembly includes a ratchet assembly for restraining the piston.

13. An assembly as claimed in claim 12, wherein the ratchet assembly is a ball race ratchet including a ball race track formed in an outer surface of the piston and a ball adapted to engage in the track.

14. An assembly as claimed in claim 9, wherein the piston is moved axially by variation of fluid pressure applied to the piston.

15. An assembly as claimed in claim 9, wherein the assembly includes the plurality of chambers and corresponding valve assemblies, for controlling the operation of a plurality of downhole tools.

16. An assembly as claimed in claim 9, in combination with at least first and second downhole tools and wherein each downhole tool is coupled to the hydraulic control assembly in a closed loop with the fluid in the respective chamber.

17. An assembly as claimed in claim 9, wherein the tool control fluid ports of each chamber are spaced axially along the respective chamber and are selectively isolated from one another by the valve assembly.

18. An assembly as claimed in claim 9, wherein each valve assembly comprises a valve member located in a respective chamber, to selectively isolate the respective tool control fluid ports.

19. An assembly as claimed in claim 9, wherein each chamber of the assembly comprises four tool control fluid flow ports, two fluid supply ports for flow of the tool control fluid to a respective tool, and two fluid return ports for return of the tool control fluid from a respective tool.

20. An assembly as claimed in claim 19, wherein in the deactivated position, each valve member isolates the respective tool control fluid ports to prevent communication between the ports.

21. An assembly as claimed in claim 9, wherein each valve assembly comprises a member movable between deactivated and activated positions, where the member respectively prevents and allows tool control fluid flow to and from a respective tool, and wherein the control assembly further comprises biassing means for biassing each valve member towards the deactivated position.

22. An assembly as claimed in claim 21, wherein in the activated position, each valve assembly permits flow of tool control fluid between the respective tool control fluid ports.

23. An assembly as claimed in claim 9, wherein each valve assembly comprises an axially moveable plunger.

24. An assembly as claimed in claim 23, wherein each plunger is spring biassed and has an end adapted to be engaged by the piston.

25. An assembly as claimed in claim 23, wherein each plunger is substantially cylindrical and includes a hollow portion defining a fluid conduit within the cylinder, for selectively allowing fluid flow between the respective tool control fluid ports.

26. An assembly as claimed in claim 25, wherein each chamber of the control assembly includes two fluid supply flow ports and two fluid return flow ports and wherein two said hollow portions are provided, one for each of the two fluid supply flow ports and fluid return flow ports.

27. An assembly as claimed in claim 25, wherein said hollow portion of each plunger includes apertures in a wall thereof.

28. An assembly as claimed in claim 9, wherein the assembly further comprises a tool control fluid reservoir coupled to each chamber.

29. An assembly as claimed in claim 9, wherein the assembly further comprises restriction orifices provided in fluid lines extending from the tool control fluid ports.

30. An assembly as claimed in claim 9, comprising at least one hydraulic control conduit for coupling the first and second chambers to the tool control fluid source.

31. An assembly as claimed in claim 9, wherein the valve assembly can be closed and subsequently reopened.

32. A method for independently, selectively controlling the operation of at least two fluid activated downhole tools, the method comprising the steps of:

fluidly coupling a hydraulic control assembly having a tool control fluid inlet and at least two tool control fluid outlets to each downhole tool via first and second control fluid supply conduits, each respective first and second conduits coupled to a respective downhole tool in a closed-loop configuration;

coupling the control assembly to a control fluid source by at least one hydraulic control conduit, to isolate the tool control fluid from borehole fluid;

locating the downhole tools and the control assembly in a borehole; and supplying control fluid from the control fluid source through said hydraulic control conduit and injecting control fluid into each downhole tool via said respective first control fluid supply conduits, whilst simultaneously bleeding fluid out of each downhole tool via said second control fluid supply conduits, to selectively activate each downhole tool.

33. A method as claimed in claim 32, wherein the method further comprises the step of measuring at least one of the volume of control fluid injected into each downhole tool and bled from each tool to allow accurate determination of an operating status of each downhole tool.

34. A hydraulic control assembly for controlling the operation of at least first and second downhole tools, the assembly being for location in a borehole of a well and comprising:

a tubular member having a tool control fluid inlet and at least first and second tool control fluid outlets, the inlet adapted to be coupled to a tool control fluid source by at least one hydraulic control conduit such that the tool control fluid is isolated from borehole fluid; and a valve assembly for selectively allowing fluid flow between the tool control fluid source and the inlet of the tubular member and between the tool control fluid inlet and each of the first and second tool control fluid outlets, and for selectively defining independent first and second fluid flow paths between the respective first and second tool control fluid outlets and the respective first and second downhole tools, to provide independent, selective control of the operation of each downhole tool.

35. An assembly as claimed in claim 34, wherein the valve assembly can be closed and subsequently reopened.

36. A hydraulic control assembly for controlling the operation of at least a first and second downhole tool, the assembly being for location in a borehole of a well and comprising:

a tubular member having a tool control fluid inlet means and at least a first and a second tool control fluid outlet, the first and second outlets for coupling to the respective first and second downhole tool and the inlet means adapted to be coupled to a tool control fluid source by at least one control conduit such that the tool control fluid is isolated from borehole fluid; and a valve assembly for selectively allowing flow of tool control fluid between the tool control fluid source and the inlet means, between the inlet means and the first tool control fluid outlet and between the inlet means and the second tool control fluid outlet, to provide independent, selective control of the operation of each downhole tool.

37. A method for independently, selectively controlling the operation of at least two fluid activated downhole tools, the method comprising the steps of:

fluidly coupling a hydraulic control assembly having a tool control fluid inlet and at least two tool control fluid outlets to each downhole tool via first and second control fluid supply conduits, each respective first and second conduits coupled to a respective downhole tool in a closed-loop configuration;

fluidly coupling the tool control fluid inlet to a tool control fluid source by at least one hydraulic control conduit such that the control fluid is isolated from borehole fluid;

locating the downhole tools and the control assembly in a borehole;

supplying tool control fluid from the tool control fluid source to the tool control fluid inlet through said hydraulic control conduit;

supplying control fluid from the hydraulic control assembly to each downhole tool via said respective first control fluid supply conduits, whilst simultaneously bleeding fluid out of each downhole tool via said second control fluid supply conduits, to selectively activate each downhole tool.

38. A method as claimed in claim 37, comprising closing flow of control fluid from the control assembly to a selected downhole tool and then subsequently reopening flow of control fluid to the selected downhole tool.

* * * * *

UNITED STATES PATENT AND TRADEMARK OFFICE

CERTIFICATE OF CORRECTION

PATENT NO. : 6,595,296 B1
DATED : July 22, 2003
INVENTOR(S) : Clive John French

It is certified that error appears in the above-identified patent and that said Letters Patent is hereby corrected as shown below:

Title page,
Item [54], Title, replace "HYDRAULIC CONTROL ASSEMBLY" with -- METHOD AND APPARATUS FOR A HYDRAULIC CONTROL ASSEMBLY --.

Column 1,
Line 50, replace "activated" with -- activated, --.

Column 5,
Line 16, replace "of" with -- or -- (first occurrence).

Signed and Sealed this

Twenty-seventh Day of January, 2004

JON W. DUDAS
*Acting Director of the United States Patent and Trademark Office*